US007175359B2

(12) United States Patent
Zhang et al.

(10) Patent No.: US 7,175,359 B2
(45) Date of Patent: Feb. 13, 2007

(54) COSMETICIZING PEN

(76) Inventors: Jun Zhang, 2F., No. 8, Jhuangjing St., Sijhih City, Taipei County 221 (TW); Chen-Ling Liu, 2F., No. 8, Jhuangjing St., Sijhih City, Taipei County 221 (TW)

( * ) Notice: Subject to any disclaimer, the term of this patent is extended or adjusted under 35 U.S.C. 154(b) by 61 days.

(21) Appl. No.: 11/041,594

(22) Filed: Jan. 24, 2005

(65) Prior Publication Data

US 2006/0165474 A1 Jul. 27, 2006

(51) Int. Cl.
*B43K 5/06* (2006.01)

(52) U.S. Cl. ..... 401/172; 401/68

(58) Field of Classification Search ..... 401/30–33, 401/65, 68, 74, 172
See application file for complete search history.

(56) References Cited

U.S. PATENT DOCUMENTS 2,513,201 A * 6/1950 Reddemann ..... 401/31
5,306,107 A * 4/1994 Kageyama et al. ..... 401/29
6,368,001 B1 * 4/2002 Roeder ..... 401/31

* cited by examiner

*Primary Examiner*—Justine Yu
(74) *Attorney, Agent, or Firm*—Alan D. Kamrath; Nikolai & Mersereau, P.A.

(57) ABSTRACT

A cosmeticizing pen includes a sleeve a guider mounted in the sleeve. Two shanks respectively longitudinally mounted to two opposite end of the guider and two drive devices respectively mounted in the two shanks. The sleeve is selectively connected to a corresponding one of the two drives to squeeze out the cosmetic in the shank that contains the corresponding drive device.

11 Claims, 7 Drawing Sheets

COSMETICIZING PEN

BACKGROUND OF THE INVENTION

1. Field of the Invention

The present invention relates to a cosmeticizing pen, and more particularly to a cosmeticizing pen that contains two different cosmetics in two opposite ends thereof.

2. Description of Related Art

A conventional cosmeticizing pen in accordance with the prior art shown in FIGS. 6 and 7 comprises a shank (70) having a through hole (71) longitudinally centrally defined in the shank (70) for containing the cosmetic. The through hole (71) has a polygonal section (72) formed on a middle portion of the hollow shank (70) and an annular groove (73) defined in an inner periphery of the through hole (71) near a rear end of the hollow shank (70). A guider (74) is longitudinally attached to a front end of the hollow shank (70) for guiding the cosmetic squeezed out of the shank (70). A cap (75) covers the guider (74) and is attached to the front end of the hollow shank (70) for protecting the guider (74) after use.

An actuated rod (76) is received in the hollow shank (70) and a having a threaded outer periphery (77) formed thereon. The actuated rod (76) is longitudinally movably received in the hollow shank (70). A sealant (78) abuts the inner periphery of the polygonal section (72) to form an airtight effect between the actuated rod (70) and the inner periphery of the polygonal section (72).

A rotor (80) is rotatably mounted to the rear end of the shank (70). The rotor (80) includes a hollow driver (81) formed on one end thereof and rotatably received in the through hole (71) in the shank (70). The driver (81) has a threaded hole (82) centrally defined therein and the actuated rod (76) is partially screwed into the threaded hole (82) due to the threaded outer periphery (77) thereof. A flange (83) outwardly radially extends from the protrusion (81) and rotatably received in the annular groove (73) when the rotor (80) is longitudinally mounted to the rear end of the shank (70).

When operating, the cap (75) is detached from the front end of the shank (70). The rotor (80) is rotated and the actuated rod (76) is moved toward the front end of the shank (70) for squeezing the cosmetic from the shank (70) to the guider (74) for user to dress.

However, the conventional cosmeticizing pen contains only one cosmetic. The user needs to prepare multiple conventional cosmeticizing pens for containing various cosmetics. It is inconvenient. Furthermore, the multiple conventional cosmeticizing pens will occupy most of the room in the handbag.

The present invention has arisen to mitigate and/or obviate the disadvantages of the conventional cosmeticizing pen.

SUMMARY OF THE INVENTION

The main objective of the present invention is to provide an improved cosmeticizing pen that contains two different cosmetics in two opposite ends thereof.

To achieve the objective, the cosmeticizing pen in accordance with the present invention comprises a sleeve and a guider selectively rotatably received in the sleeve. A through hole is centrally defined in the guider. The through hole has a first threaded section and a second threaded section respectively formed on an inner periphery thereof, wherein the first threaded section has a diameter greater than that of the second threaded section. A first shank and a second shank are respectively pivotally and longitudinally mounted to two opposite end of the guider, and partially received in the sleeve. The sleeve is selectively connected to a corresponding one of the first shank and the second shank. A first drive device is mounted in the first shank. The first drive device includes a first actuated rod with a threaded outer periphery partially screwed into the first threaded section of the through hole in the guider. A first holder is sleeved on the first actuated rod and linearly moved relative to the first actuated rod. A first piston is longitudinally mounted to one end of the first actuated opposite to the guider. A second drive device is mounted in the second shank. The second drive device includes a second actuated rod with a threaded outer periphery screwed into the second threaded section of the through hole in the guider and partially extending into a through hole that is centrally longitudinally defined in the first actuated rod. A second holder is sleeved on the second actuated rod and linearly moved relative to the second actuated rod. A second piston is longitudinally mounted to one end of the second actuated opposite to the guider.

Further benefits and advantages of the present invention will become apparent after a careful reading of the detailed description with appropriate reference to the accompanying drawings.

DETAILED DESCRIPTION OF THE INVENTION

Figure 1:
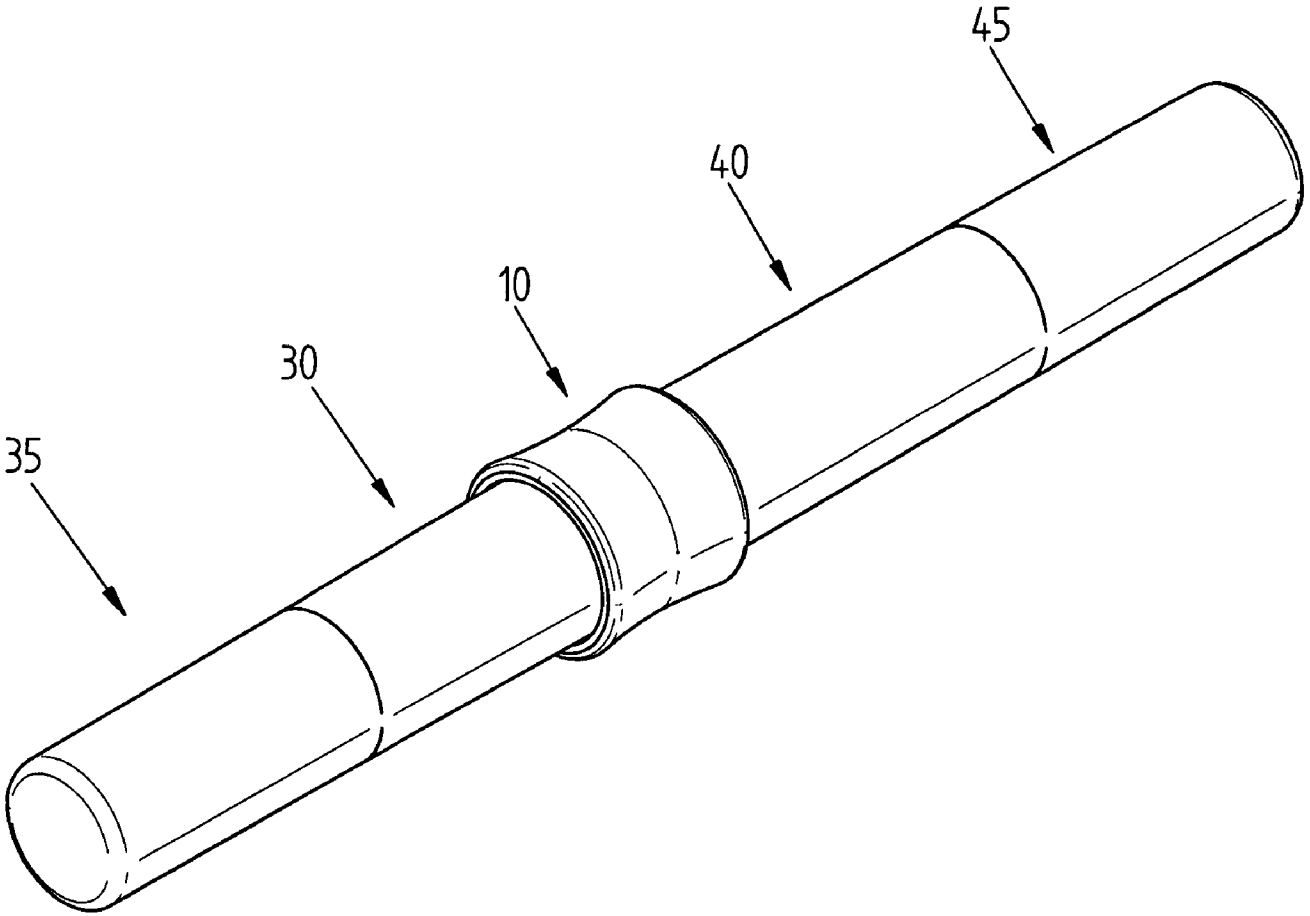
FIG. 1 is a perspective view of a cosmeticizing pen in accordance with the present invention.
Figure 2:
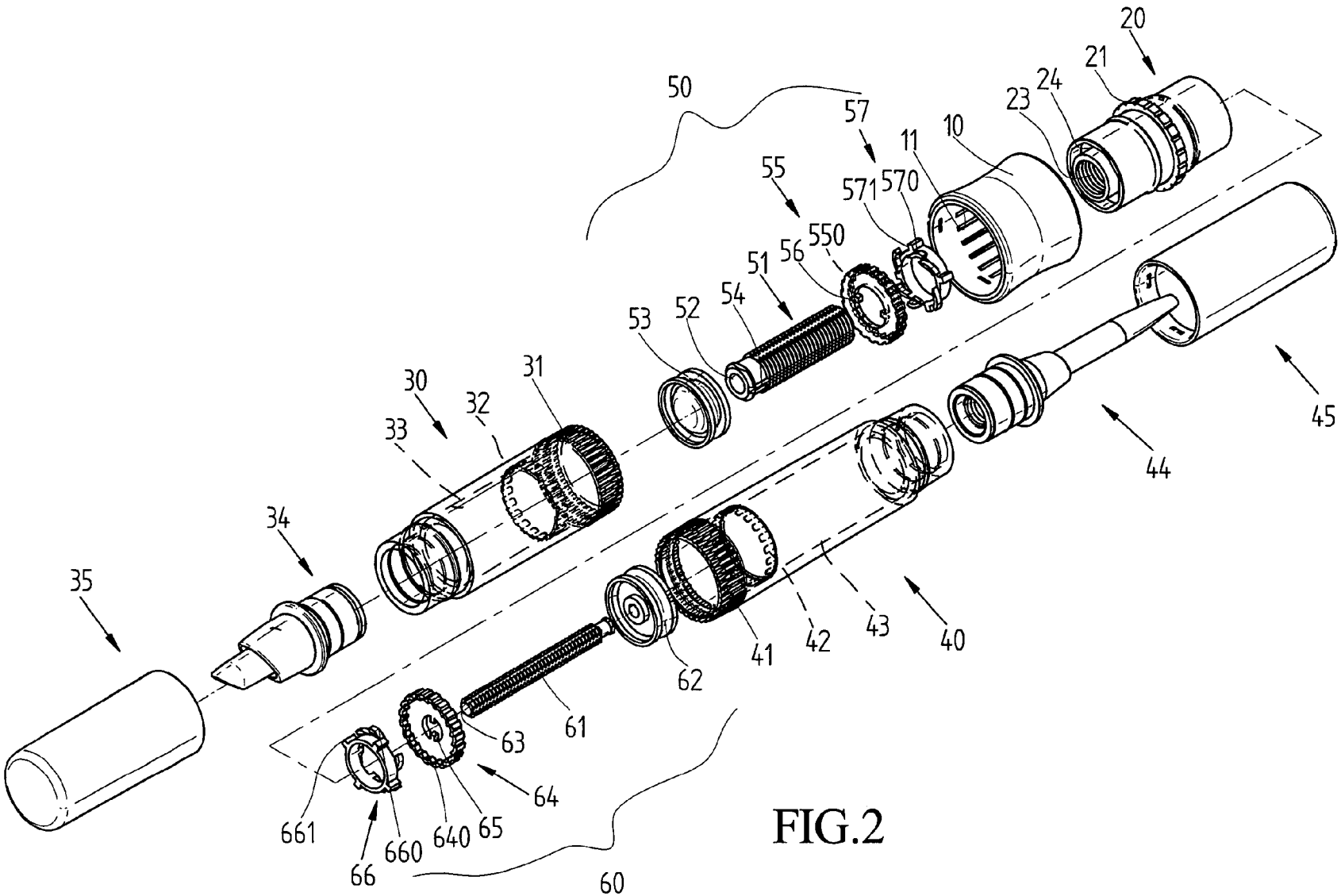
FIG. 2 is an exploded perspective view of the cosmeticizing pen in FIG. 1.
Figure 3:
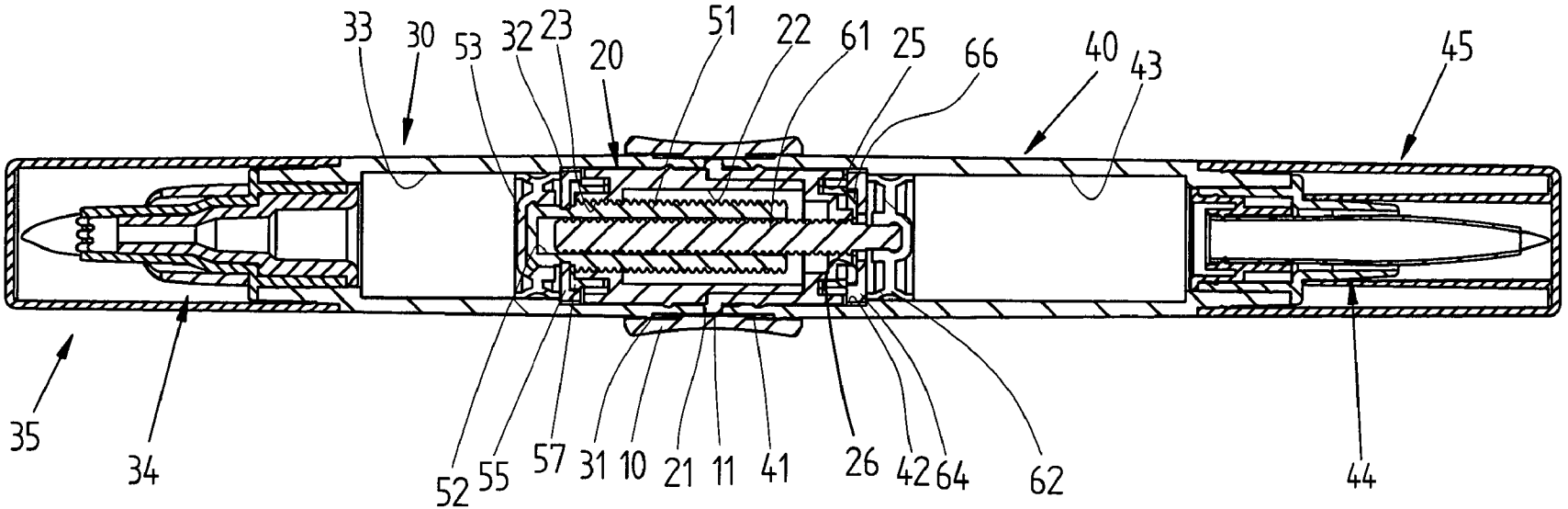
FIG. 3 is a cross-sectional view of the cosmeticizing pen in FIG. 1.

Referring to the drawings and initially to FIGS. 1–3, a cosmeticizing pen in accordance with the present invention comprises sleeve (10) having a first series of teeth (11) longitudinally formed on an inner periphery of the sleeve (10).

A guider (20) is received in the sleeve (10). The guider (20) includes a second series of teeth (21) formed on an outer periphery thereof and engaged to the first series of teeth (11) of the sleeve (10). A first groove (24) and a second groove (25) are respectively defined in a first end and a second end of the guider (20). A through hole (22) centrally longitudinally defined in the guider (20). The through hole (22) includes a first threaded section (23) and a second threaded section (26) formed on an inner periphery thereof and respectively corresponding to the first groove (24) and the second groove (25). The first threaded section (23) has a diameter greater than that of the second threaded section (26).

A first hollow shank (30) has a first end sleeved on the first end of the guider (20) and a second hollow shank (40) has a first end sleeved on the second end of the guider (20). The first shank (30) and the second shank (40) respectively have a third series of teeth (31) and a fourth series of teeth (41)

formed on an outer periphery of the first end of each of the first shank (30) and the second shank (40). The third series of teeth (31) and the fourth series of teeth (41) respectively selectively engage to the first series of teeth (11) of the sleeve (10). A first chamber (33) is longitudinally defined in the first shank (30) and a fifth series of teeth (32) is formed on an inner periphery of the first chamber (33) near the first end of the first shank (30). A second chamber (43) is longitudinally defined in the second shank (40) and a sixth series of teeth (42) is formed on an inner periphery of the second chamber (43) near the first end of the second shank (40).

A first head (34) and a second head (44) are respectively longitudinally mounted to a second end of each of the first shank (30) and the second shank (40). A first cap (35) and a second cap (45) are respectively longitudinally mounted to the first head (34) and the second head (44) for protecting the first head (34) and the second head (44) from a bump after using the cosmeticizing pen.

A first drive device (50) is disposed in the first chamber (33) in the first shank (30). The first drive device (50) includes a first actuated rod (51) having a threaded outer periphery screwed into the first threaded section (23) of the through hole (22) in the guider (20). A through hole (52) is longitudinally centrally defined in the first actuated rod (51). Two first slits (54) are longitudinally defined in the outer periphery of the first actuated rod (51) and diametrically correspond to each other.

A first pusher (57) is sleeved on the first actuated rod (51) and partially received in the first groove (24) in the guider (20). The first pusher (57) includes multiple first protrusions (570) outwardly extending therefrom and engaged to a periphery of the first groove (24) to prevent the first pusher (57) from rotating relative to the guider (20). The first pusher (57) has one side opposite to the guider (20) and having a first ring of ratchet (571) formed on the pusher (57). A first piston (53) is mounted on one end of the first actuated rod (51) opposite to the first pusher (57).

A first holder (55) is sleeved on the first actuated rod (51) between the first pusher (57) and the first piston (53). The first holder (55) has a teethed periphery engaged to the fifth series of teeth (32) of the first shank (30). A first recess (550) is defined in one side of the first holder (55) and faces the first pusher (57). The first holder (55) has a series of ratchet formed on a periphery of the first recess (550) and engaged to the first ratchet (571) of the first pusher (57) to make first pusher (57) only be rotated in one direction relative to the first holder (55). The first holder (55) has two first guiders (56) inwardly extending therefrom and each movably received in a corresponding one of the two first slits (54) of the first actuated rod (51) such that the first holder (55) only linearly moved relative to the first actuated rod (51).

A second drive device (60) is mounted in the second shank (40). The second drive device (60) includes a second actuated rod (61) having a threaded outer periphery. The second actuated rod (61) is screwed into the second threaded section (26) of the guider (20), extends the guider (20) and partially received in the through hole (52) in the first actuated rod (51). The second actuated rod (61) has two second slits (63) defined in the outer periphery thereof and diametrically corresponding to each other.

A second pusher (66) is sleeved on the second actuated rod (61) and partially received in the second groove (25) in the guider (20). The second pusher (66) includes multiple second protrusions (660) outwardly extending therefrom and engaged to a periphery of the second groove (25) to prevent the second pusher (66) from rotating relative to the guider (20). The second pusher (66) has one side opposite to the guider (20) and having a second ring of ratchet (661) formed on the second pusher (66). A second piston (62) is mounted on one end of the second actuated rod (61) opposite to the second pusher (66).

A second holder (64) is sleeved on the second actuated rod (61) between the second pusher (66) and the second piston (62). The second holder (64) has a teethed periphery engaged to the sixth series of teeth (42) of the second shank (40). A second recess (640) is defined in one side of the second holder (64) and faces the second pusher (66). The second holder (64) has a series of ratchet formed on a periphery of the second recess (640) and engaged to the second ring of ratchet (661) of the second pusher (66) to make second pusher (66) only be rotated in one direction relative to the second holder (64). The second holder (64) has two second guiders (65) inwardly extending therefrom and each movably received in a corresponding one of the two second slits (63) of the second actuated rod (61) such that the second holder (64) only linearly moved relative to the second actuated rod (61).

Figure 4:
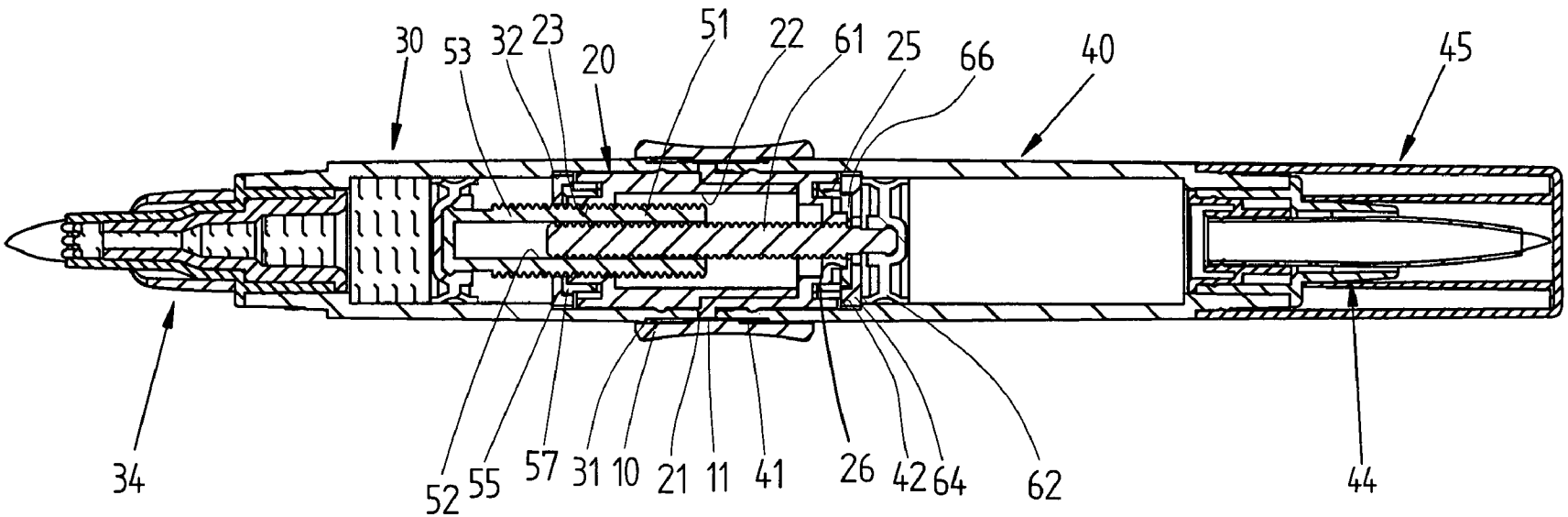
FIG. 4 is an operational view in cross-section of the cosmeticizing pen of the present invention.
Figure 5:
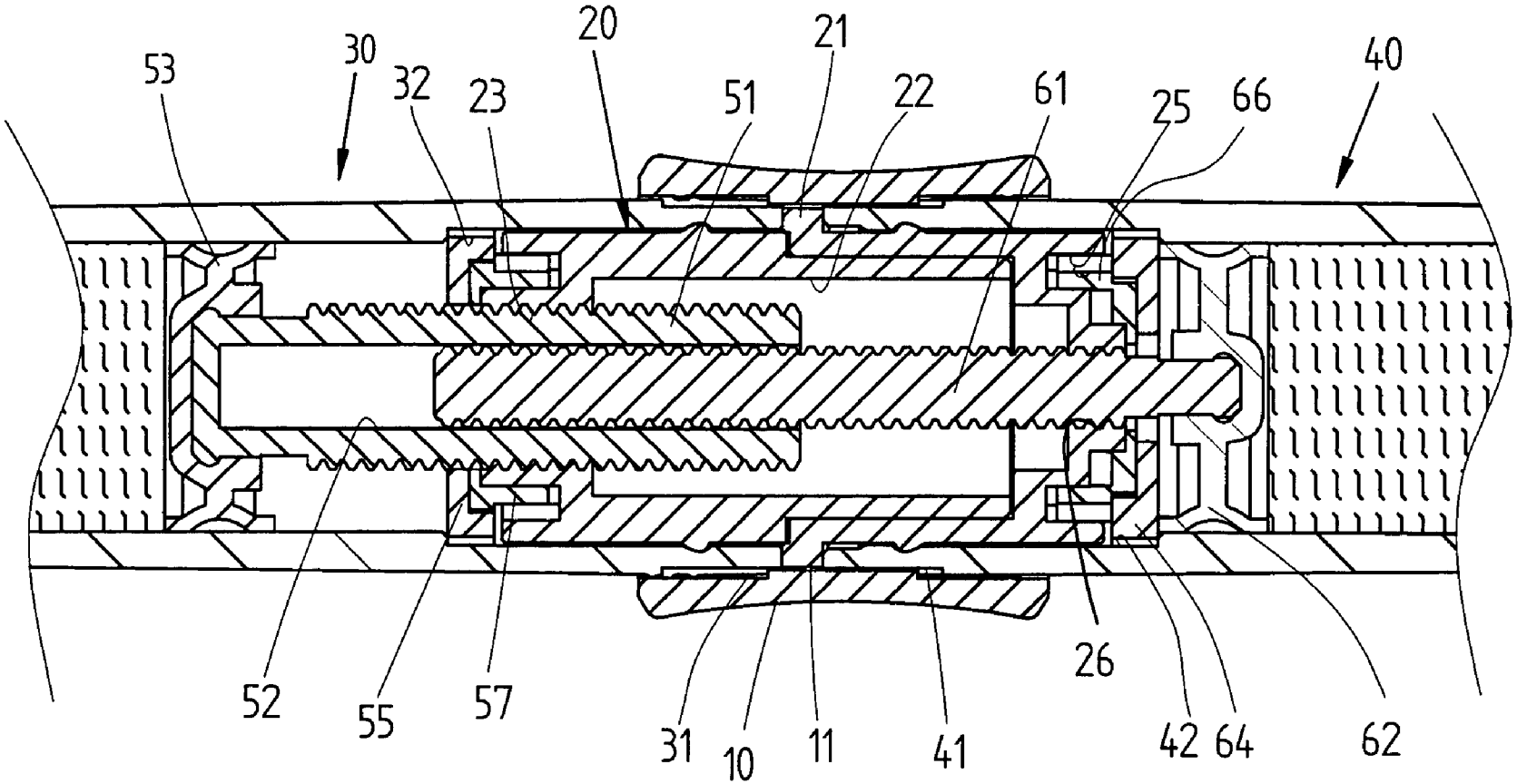
FIG. 5 is a partially enlarged view of FIG. 4.
Figure 6:
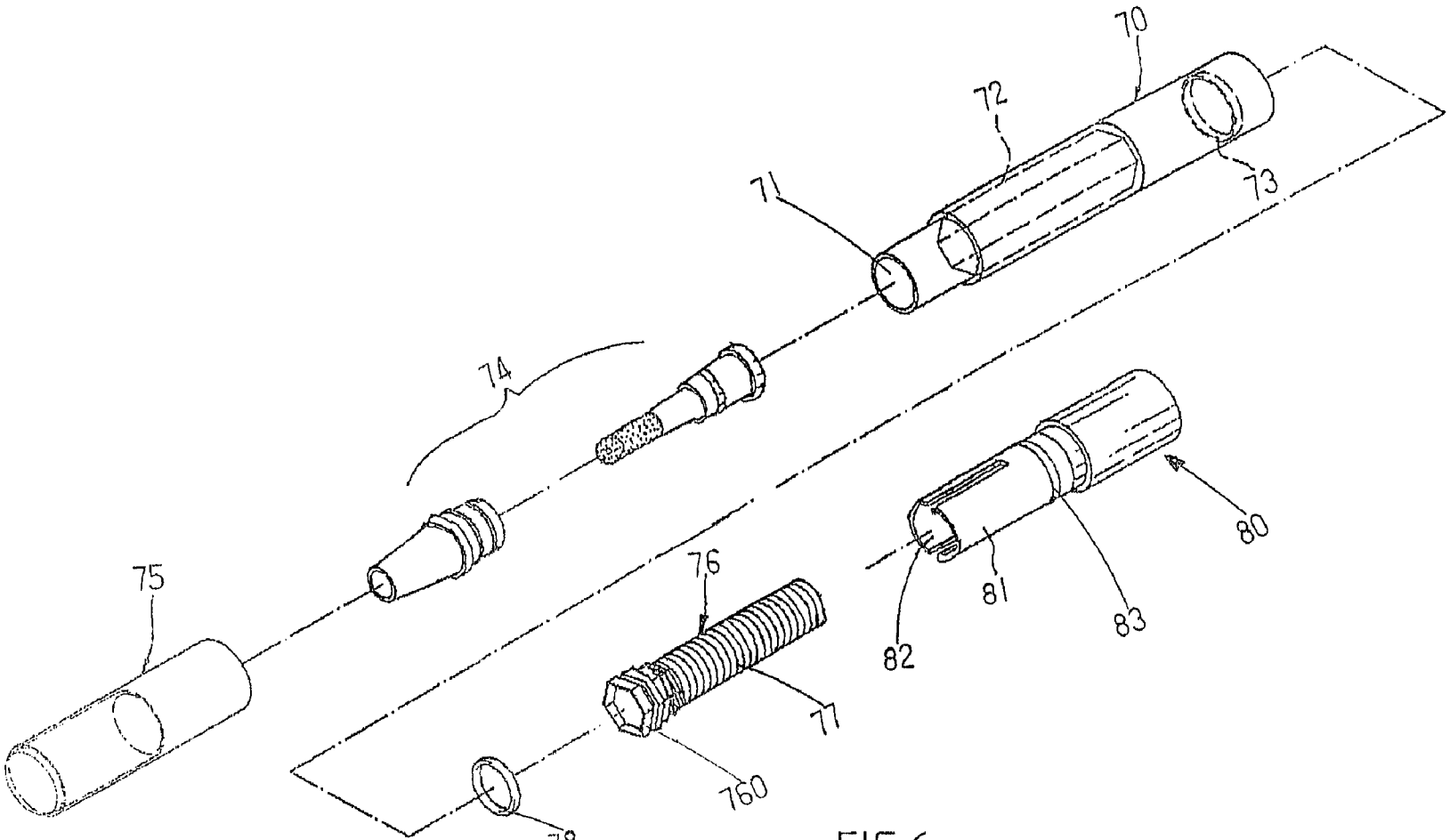
FIG.6 PRIOR ART
FIG. 6 is an exploded perspective view of a conventional cosmeticizing pen in accordance with the prior art.
Figure 7:
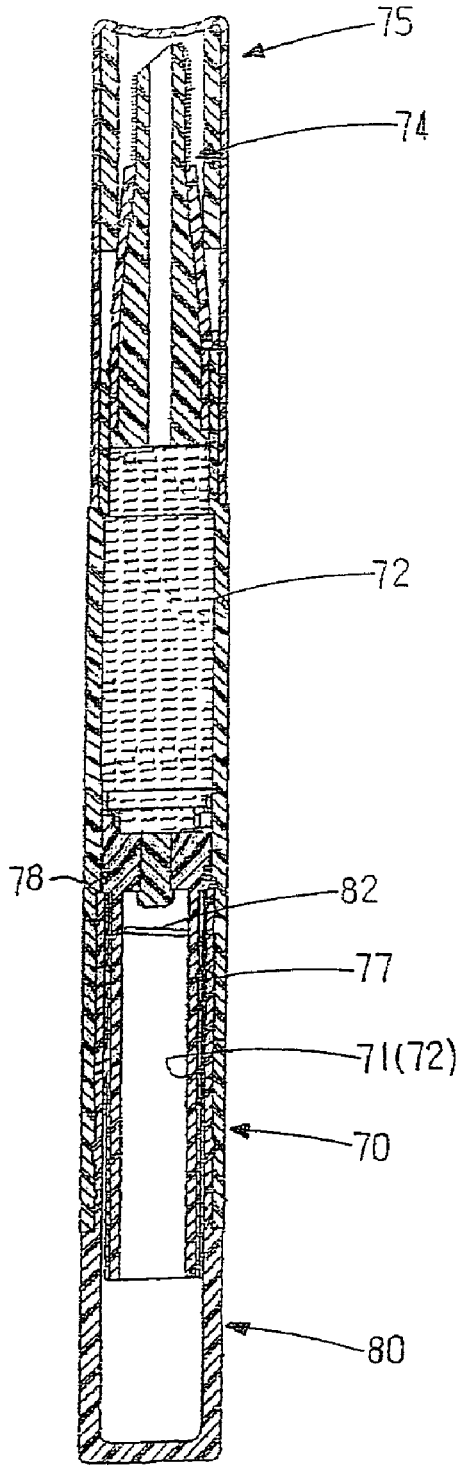
FIG.7 PRIOR ART
FIG. 7 is a cross-sectional view of the conventional cosmeticizing pen in FIG. 6.

With reference to FIGS. 3–5, when operating the cosmeticizing pen in accordance with the present invention, for example, when using the first head (34), the sleeve (10) is moved toward the second shank (40) to make the first series of teeth (11) of the sleeve (10) engaged to the fourth series of teeth (41) of the seconds shank (40), and then second shank (40), the guider (20) and the sleeve (10) are longitudinally connected to one another and can not be rotated relative to one another. When rotating the first shank (30), the fifth series of teeth (32) of the first shank (30) drives first holder (55) of the first drive device (50) and the two first guiders (56) of the first holder (55) rotate the first actuated rod (51). As a result, the first holder (55) is rotated relative to the first pusher (57) in one direction and the first actuated rod (51) is screwed into the first threaded section (23) of the through hole (22) in the guider (20). The first actuated rod (51) extends to drive the first piston (53) moved toward the first head for squeezing the cosmetic that is contained in the fist shank (30) because the guider (20) is limited and not rotated.

Although the invention has been explained in relation to its preferred embodiment, it is to be understood that many other possible modifications and variations can be made without departing from the spirit and scope of the invention as hereinafter claimed.

What is claimed is:

1. A cosmeticizing pen comprising:

a sleeve;

a guider selectively rotatably received in the sleeve, a through hole centrally defined in the guider, the through hole having a first threaded section and a second threaded section respectively formed on an inner periphery of the through hole, the first threaded section having a diameter greater than that of the second threaded section;

a first shank and a second shank respectively pivotally and longitudinally mounted to two opposite ends of the guider, and partially received in the sleeve, the sleeve selectively connected to a corresponding one of the first shank and the second shank;

a first drive device mounted in the first shank, the first drive device including a first actuated rod with a threaded outer periphery partially screwed into the first threaded section of the through hole in the guider, a first holder sleeved on the first actuated rod and linearly moved relative to the first actuated rod, a first piston longitudinally mounted to one end of the first actuated rod opposite to the guider; and a second drive device mounted in the second shank, the second drive device including a second actuated rod with a threaded outer periphery screwed into the second threaded section of the through hole in the guider and partially extending into a through hole that is centrally longitudinally defined in the first actuated rod, a second holder sleeved on the second actuated rod and linearly moved relative to the second actuated rod, a second piston longitudinally mounted to one end of the second actuated rod opposite to the guider;

wherein the sleeve has a first series of teeth longitudinally formed on an inner periphery thereof, the guider having a second series of teeth formed on an outer periphery thereof and engaged to the first series of teeth of the sleeve, the first shank and the second shank respectively having a third series of teeth and a fourth series of teeth formed thereon within the sleeve such that the first series of teeth of the sleeve is selectively engaged to a corresponding one of the third series of teeth and the fourth series of teeth.

2. The cosmeticizing pen as claimed in claim 1, wherein the first shank comprises a first chamber longitudinally defined therein and a fifth series of teeth formed on an inner periphery of the first chamber, the first actuated rod has at least one first slit longitudinally defined in the outer periphery thereof, the first holder having a teethed periphery engaged to the fifth series of teeth, the first holder having at least one first guider extending therefrom and movably received in the at least one first slit.

3. The cosmeticizing pen as claimed in claim 2, wherein the first actuated rod has two first slits defined in the outer periphery thereof and diametrically corresponding to each other.

4. The cosmeticizing pen as claimed in claim 2, wherein the guider comprises a first groove defined in one end thereof surrounding the through hole and facing the first shank, a first pusher sleeved on the first actuated rod and partially received in the first groove, the first pusher having a first ring of ratchet formed thereon out of the first groove, the first holder having a first recess defined therein facing the first pusher, the first recess having a teethed inner periphery engaged to the first ring of ratchet.

5. The cosmeticizing pen as claimed in claim 4, wherein the first pusher comprises multiple first protrusions outwardly extending therefrom to be engaged to the periphery of the first groove in the guider.

6. The cosmeticizing pen as claimed in claim 4, wherein the guider comprises a second groove defined in one end thereof surrounding the through hole and facing the second shank, a second pusher sleeved on the second actuated rod and partially received in the second groove, the second pusher having a second ring of ratchet formed thereon out of the second groove, the second holder having a second recess defined therein facing the second pusher, the second recess having a teethed inner periphery engaged to the second ring of ratchet.

7. The cosmeticizing pen as claimed in claim 6, wherein the second actuated rod has two second slits longitudinally defined in the outer periphery thereof and diametrically corresponding to each other.

8. The cosmeticizing pen as claimed in claim 2, wherein the second shank comprises a second chamber longitudinally defined therein and a sixth series of teeth formed on an inner periphery of the second chamber, the second actuated rod having at least one second slit longitudinally defined in the outer periphery thereof, the second holder having a teethed periphery engaged to the sixth series of teeth, the second holder having at least one second guider extending therefrom and movably received in the at least one second slit.

9. The cosmeticizing pen as claimed in claim 8, wherein the second actuated rod has two second slits defined in the outer periphery thereof and diametrically corresponding to each other.

10. The cosmeticizing pen as claimed in claim 1 further comprising a first head and a second head respectively longitudinally mounted to the first shank and the second shank.

11. The cosmeticizing pen as claimed in claim 10 further comprising a first cap and a second cap respectively detachably covered on the first head and the second head.

* * * * *